United States Patent [19]

Cosaert

[11] 4,446,641

[45] May 8, 1984

[54] ALTERABLE FRAME AND SMALL FASTENING BLOCK FOR ASSEMBLING SUCH A FRAME

[75] Inventor: Marijke Cosaert, Kasteelbrakel, Belgium

[73] Assignee: Lineair, Belgium

[21] Appl. No.: 344,942

[22] Filed: Feb. 2, 1982

[30] Foreign Application Priority Data

Feb. 27, 1981 [BE] Belgium ..... 887715

[51] Int. Cl.[3] ..... A47G 1/06

[52] U.S. Cl. ..... 40/152; 40/154; 40/156; 40/158 R; 40/157; 40/155

[58] Field of Search ..... 40/152, 152.1, 154, 40/156, 158 R, 158 B, 159, 157, 155

[56] References Cited

U.S. PATENT DOCUMENTS

| | | | |
|---|---|---|---|
| 549,337 | 11/1895 | Stagg, Jr. | 40/156 |
| 1,481,120 | 1/1924 | Brombosz | 40/155 |
| 1,963,124 | 6/1934 | Free | 40/155 |
| 1,982,143 | 11/1934 | Schill | 40/155 |
| 2,471,545 | 5/1949 | Rosenberg et al. | 40/156 |
| 3,665,628 | 5/1972 | Dammond | 40/155 |
| 3,782,015 | 1/1974 | Esry | 40/154 |
| 3,867,774 | 2/1975 | Kise | 40/155 |
| 3,935,656 | 2/1976 | Pritchard | 40/155 |
| 3,981,091 | 9/1976 | Wiener, Jr. | 40/156 |
| 4,204,350 | 5/1980 | Brenner | 40/156 |
| 4,219,949 | 9/1980 | McGurk | 40/156 |
| 4,233,765 | 11/1980 | O'Mullan et al. | 40/156 |
| 4,271,619 | 6/1981 | Schmidt | 40/155 |
| 4,352,630 | 10/1982 | Wallo | 46/157 |
| 4,356,647 | 11/1982 | Farris | 40/152.1 |

*Primary Examiner*—Gene Mancene
*Assistant Examiner*—Cary E. Stone
*Attorney, Agent, or Firm*—Scully, Scott, Murphy & Presser

[57] ABSTRACT

There is described an alterable or change-over frame which is comprised on the one hand of a series of small fastening blocks mounted at some interval from one another on the panel edges, and on the other hand of flexible U-shaped sections which extend between said fastening blocks and which are clamped over the panel edges.

15 Claims, 3 Drawing Figures

ALTERABLE FRAME AND SMALL FASTENING BLOCK FOR ASSEMBLING SUCH A FRAME

This invention pertains to a frame, more particularly an alterable frame for fastening panels upon one another, particularly pictures, photographs, paintings, reproductions, etc. between a front glass pane and a bearing plate.

The invention has for object to provide a frame which may be very simply and efficiently arranged about a panel to be hung, more particularly a photograph, painting, reproduction, mirror or similar, independently from the size of the panel concerned.

Moreover when the photographs, paintings, pictures, reproductions, etc. have been laid between a bearing plate and a glass pane, the entering of dust and possibly moisture is completely prevented due to the frame according to the invention.

For this purpose, the frame according to the invention is comprised on the one hand of a series of small fastening blocks mounted at some interval from one another on the panel edges, and on the other hand of flexible U-shaped sections which extend between said fastening blocks and which are clamped over the panel edges.

Usefully, said U-shaped sections extend over the whole length of said edges between two succeeding fastening blocks, and said sections are also clamped between said fastening blocks.

In a particular embodiment of the invention, both said fastening blocks and said U-shaped sections are transparent.

In a more particular embodiment of the invention, a cap screw is screwed into each said fastening blocks, the screw axis lying substantially at right angle to a panel to be framed and the free screw end enters a corresponding recess provided adjacent the panel edge, more particularly the bearing plate edge, and the panel bears against an upstanding, inwards-bent edge of the fastening block which forms a rest for the panel edge, said bent edge extending in parallel relationship with the panel along the outermost surface of said fastening block.

The invention further relates to the above-defined fastening block for frames, more particularly alterable or change-over frames.

Other details and features of the invention will stand out from the following description given by way of non limitative example and with reference to the accompanying drawings, in which.

In the various figures, the same reference numerals pertain to similar elements.

Figure 1:
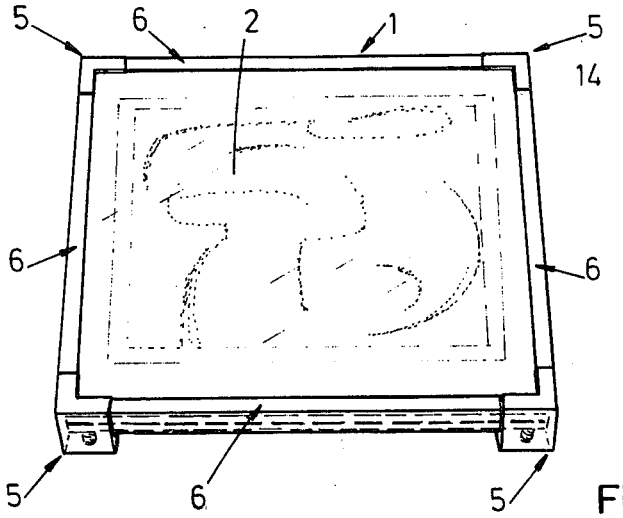
FIG. 1 is a perspective view from a picture or similar, which is surrounded by a frame according to the invention.

In the figures has been shown a frame 1 which surrounds the edges from a decorating plate 2, such as a drawing, photograph, painting, reproduction or similar, between a bearing plate 3 and a glass pane 4. Said frame is comprised on the one hand of four small fastening blocks 5 which are mounted on the corners from said plates 2, 3 and 4, and on the other hand of flexible U-shaped sections 6 which extend between said fastening blocks 5 and are clamped on the panel edges.

Both the fastening blocks 5 and the U-shaped sections 6 are transparent, in such a way that said components are substantially not visible and let the framed plate 2 come fully to the view.

Figure 3:
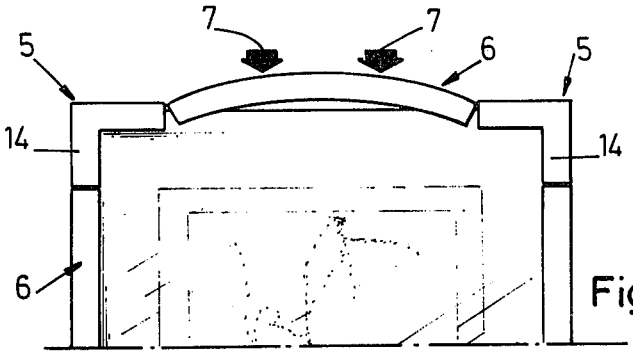
FIG. 3 is a front view from part of a panel during the assembly of the frame according to the invention.

The U-shaped sections are preferably made from flexible plastic material, more particularly polyethylene, and they extend over the whole length of said edges between two succeeding fastening blocks 5, in such a way that said sections are also clamped between said blocks. As it appears clearly from FIG. 3, said U-shaped sections 6 are arranged in a slightly bowed condition between two succeeding fastening blocks 5 over the edges of the superimposed plates or panels, in such a way that the ends thereof press against said fastening blocks 5 and consequently a pressure is exerted on the middle portion from said section 6 as shown by arrow 7, until the side surfaces 8 and 9 from said section slide over said panel edges.

Figure 2:
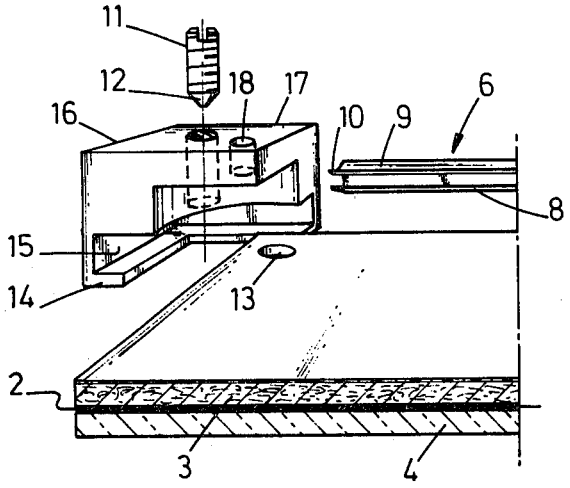
FIG. 2 is a perspective view from a detail of the frame as shown in FIG. 1, whereby the various components are shown away from one another.

As it appears from FIG. 2, said side surfaces 8 and 9 from sections 6 are somewhat directed inwards to clamp resiliently the panel edges. Moreover the free edge 10 from side surface 9 which lies on the frame back side, is slantingly directed outwards to allow in a simple way the removing thereof when dismantling said frame 1.

Into each said fastening blocks 5 is screwed a cap screw 11 the axis of which lies substantially at right angle to said superimposed panels 2, 3 and 4 to be surrounded. The free end 12 from said cap screw 11 is tapered and enters a recess 13 which is provided adjacent the edge of said bearing plate 3 in the corner thereof. Said cap screw 11 thus presses the panel against an upstanding edge 14 from the fastening block 5, said edge 14 being bent inwards in parallel relationship with said panels, whereby the screw head 11 is completely sunk into said block 5. Said square-bent edge or rim 14 defines a rest for the panel corner edges and extends from the outermost surfaces 16 and 17 of said fastening block 5.

Said glass pane 4 is comprised of polished glass, while said bearing plate 3 is made from cardboard with a plastified back.

Consequently the complete unit has a very finished, luxurious and at the same time ornamental appearence.

Hanging means not shown in the figures may be arranged on the back side of said bearing plate. Possibly said means may lie on the fastening block proper. It is for example but required to provide in the back side of said blocks, a small hole 18 wherein a hanging string may be secured. Said small holes might also be used to hang the frame directly against the wall by means of small hooks provided therefor.

It must be understood that the invention is in no way limited to the above embodiments and that many changes may be brought therein without departing from the scope of the invention as defined by the appended claims.

For instance, the small fastening blocks 5 may be so designed as to be also suitable for framing not only rectangular-shaped panels, but also circle-or ellipse-shaped panels. The frame according to the invention can also be used for hanging but one panel instead of superimposed panels, as this may for instance be the case for mirrors or reproductions on a relatively stiff ground material which would be coated with a protecting layer, in such a way that a facing glass 4 is not required.

I claim:

1. A frame designed for mounting desired art works such as pictures, photographs, mirrors, posters, prints and the like, which are fastened between a front glass pane and a bearing panel, comprising a series of fastening blocks mounted at an interval from one another on the panel edges by means of a screw, the axis of said screw lying substantially at right angle to the panel with the free screw end entering a corresponding recess provided adjacent the panel edges, a plurality of flexible U-shaped sections being clamped over the panel edges with each section extending over the whole length of said edge between two successive fastening blocks, these sections being slightly longer than the distance separating succeeding blocks, so that the ends of each of said sections press against the blocks.

2. Frame as defined in claim 1, in which for rectangle-shaped panels, said fastening blocks are formed by four corner parts wherein the panel corners are clamped.

3. Frame as defined in claim 1, in which both said fastening blocks and said U-shaped sections are transparent.

4. Frame as defined in claim 1, in which said U-shaped sections are made from flexible plastic material, more particularly polyethylene.

5. Frame as defined in claim 1, in which said fastening blocks are made from polymethylmetacrylate.

6. Frame as defined in claim 1, in which the side surfaces of the U-shaped sections are directed inwards to clamp resiliently the panel edges, and the free edge from the side surface of that U-shaped section which lies on the back side of the frame, is directed outwards at an angle.

7. Frame as defined in claim 1, in which a cap screw is screwed into each said fastening blocks until the panel bears against an upstanding, inwards-bent edge of the fastening block which forms a rest for the panel edge, said bent edge extending in parallel relationship with the panel along the outermost surfaces of said fastening block.

8. Frame as defined in claim 1, in which said glass pane is comprised of polished glass and said bearing plate is provided with a plastified back.

9. A frame designed for mounting desired art works such as pictures, photographs, mirrors, posters, prints and the like, said frame comprising:

(a) a first rigid backing member, said member defining front and rear planer surfaces, said backing member defining a plurality of recesses adjacent the edges of the backing member on the rear planar surface thereof, said front surface defining a mounting surface for said desired art works;

(b) a planar glass pane having planar dimensions which correspond to the planer dimensions of said rigid backing member, said glass pane overlying said mounting surface to protect the desired art work;

(c) a plurality of fastening blocks located at intervals around the perimeter of said backing member and glass pane, each of said fastening blocks having;

(i) a screw member mounted in said block with the axis of said screw lying substantially at right angles to the planar surface of said backing member;

(ii) said screw engaging a corresponding recess formed in the rear panel of said backing member to secure said block to said member, said screw also providing a compressive force to secure said pane to said backing member;

(d) a plurality of elongated U-shaped sections clamped over the panel edges between each of the fastening blocks, said U-shaped sections providing;

(i) a first clamping force to secure said pane to said backing member;

(ii) a second resilient force along an axis substantially perpendicular to the first clamping force, said resilient force exerting a pressure against each of the fastening blocks on either side thereof, whereby the glass pane is clamped to the backing member around its entire perimeter to protect the desired art work.

10. A frame as defined in claim 9, in which for rectangle-shaped panels, said fastening blocks are formed by four corner parts wherein the panel corners are clamped.

11. A frame as defined in claim 9, in which both said fastening blocks and said U-shaped sections are transparent.

12. A frame as defined in claim 9, in which said U-shaped sections are made from flexible plastic material, more particularly polyethylene.

13. A frame as defined in claim 9, in which said fastening blocks are made from polymethylmetacrylate.

14. A frame as defined in claim 9, in which the side surfaces of the U-shaped sections are directed inwards to clamp resiliently the panel edges, and the free edge from the side surface of that U-shaped section which lies on the back side of the frame, is directed outwards at an angle.

15. A frame as defined in claim 9, in which said glass pane is comprised of polished glass and said backing member is provided with a plastified back.

* * * * *